US007510260B2

(12) United States Patent
Lee et al.

(10) Patent No.: US 7,510,260 B2
(45) Date of Patent: Mar. 31, 2009

(54) IMAGE FORMING APPARATUS CAPABLE OF PERFORMING MAINTENANCE OPERATIONS USING USAGE PATTERN AND A METHOD FOR THE SAME

(75) Inventors: Don-Seon Lee, Yongin-si (KR); Myoung-Jin Oh, Suwon-si (KR); Bong-gi Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 351 days.

(21) Appl. No.: 11/274,189

(22) Filed: Nov. 16, 2005

(65) Prior Publication Data

US 2006/0109298 A1 May 25, 2006

(30) Foreign Application Priority Data

Nov. 22, 2004 (KR) ..... 10-2004-0095594

(51) Int. Cl.
*B41J 2/165* (2006.01)

(52) U.S. Cl. ..... 347/22; 347/23; 347/28; 347/29; 347/30

(58) Field of Classification Search ..... 347/22–36
See application file for complete search history.

(56) References Cited

FOREIGN PATENT DOCUMENTS

| | | |
|---|---|---|
| JP | 63-179777 | 7/1988 |
| JP | 04-294184 | 10/1992 |
| JP | 10-157173 | 6/1998 |
| JP | 2001-138496 | 5/2001 |
| JP | 2003-092654 | 3/2003 |
| KR | 1020000035727 | 6/2000 |

*Primary Examiner*—Stephen D Meier
*Assistant Examiner*—Ly T Tran
(74) *Attorney, Agent, or Firm*—Roylance, Abrams, Berdo & Goodman, L.L.P.

(57) ABSTRACT

An image forming apparatus capable of performing maintenance operations using a usage pattern and a method for the same. The method for performing a maintenance operation of cleaning a printing unit of the image forming apparatus comprises the steps of recording printing work information when a command for the maintenance operation is entered as usage pattern information, counting and recording the printing work information of printing data upon input of a printing command, and comparing the usage pattern information with the counted printing work information. When they correspond to each other, the maintenance operation is performed. Accordingly, maintenance operations can be conveniently performed according to a pattern of maintenance operation commands by the user.

12 Claims, 4 Drawing Sheets

IMAGE FORMING APPARATUS CAPABLE OF PERFORMING MAINTENANCE OPERATIONS USING USAGE PATTERN AND A METHOD FOR THE SAME

CROSS-REFERENCE TO RELATED APPLICATIONS

This application claims the benefit under 35 U.S.C. § 119(a) of Korean Patent Application No. 2004-95594, filed Nov. 22, 2004, the entire contents of which are hereby incorporated by reference.

BACKGROUND OF THE INVENTION

1. Field of the Invention

The present invention relates to an image forming apparatus that performs maintenance operations. More particularly, the present invention relates to an image forming apparatus that is capable of performing maintenance operations using a usage pattern, in which a message for determining whether to perform maintenance operations is displayed when the usage pattern for commanding maintenance operations corresponds to printing information, and a method for the same.

2. Description of the Related Art

Maintenance operations in an image forming apparatus prevent clogging of a printhead nozzle and contamination by ink by performing spitting, wiping and capping functions. In a spitting function, ink droplets are expelled to maintain a smooth flow of ink through the nozzle. In a wiping function, the ink nozzle is cleaned. In a capping function, the nozzle is sealed to prevent the ink from drying during periods of non-use. Generally, maintenance operations in an inkjet printer are performed before or during the printing.

Inkjet printers can generally be divided into two types of printers: thermal-bubble jet types and a piezoelectric transducer types. A thermal-bubble jet type inkjet printer electrically heats a chamber so that ink in the chamber thermally expands and is thereby jetted out through a nozzle. A piezoelectric transducer type inkjet printer drives a vibrating plate by vibrating a piezoelectric body to jet out ink in a chamber through a nozzle by the vibration.

In the thermal-bubble jet type printer, especially, a bubble generated by heating the ink stored in a cartridge is attached onto a printing paper through a nozzle, thereby performing printing. When ink adheres to and remains in the printhead, image quality may deteriorate. To prevent this, maintenance operations for removing ink adhered to the printhead are required.

FIG. 1 shows a printer body to explain conventional maintenance operations.

Referring to FIG. 1, a carriage 1 that carries an ink cartridge 3 is mounted to transversely reciprocate in the printer body. The carriage 1 moves between a printer section where the ink is jetted through a nozzle portion 5 of the ink cartridge 3 onto a printing medium and a service section where the carriage 1 is parked during non-use or where ink in the nozzle portion 5 is wiped out. A maintenance device 7 is mounted at one side of the service section.

After the ink cartridge 3 which is mounted in the carriage 1 completes printing by reciprocating in the printer section and ejecting ink onto a printing medium, the ink cartridge 3 is moved to the service section. A wiper (not shown) cleans the nozzle portion 5 smeared with ink by wiping the nozzle portion 5. While the carriage 1 is parked, a cap (not shown) disposed below the nozzle portion 5 seals the nozzle portion 5 to prevent the ink from drying in the nozzle portion 5.

Generally, maintenance operations are required when the printer is reset or the head is replaced with a new one, when a user requests maintenance operations on demand, and when the printer is kept in an idle state for a predetermined amount of time.

However, requesting maintenance operations requires the user to manually input a command through a printer driver in a host device connected to the printer. This process is cumbersome.

In addition, when maintenance operations are automatically performed based on conditions set in the printer, maintenance operations may be performed at undesirable times since it is hard for the printer to consider diverse printing conditions.

Accordingly, there is a need for an improved apparatus for performing maintenance operations in an image forming apparatus, and a method of doing the same.

SUMMARY OF THE INVENTION

An aspect of the present invention is to address at least the above problems and/or disadvantages and to provide at least the advantages described below. Accordingly, an aspect of the present invention is to provide an image forming apparatus capable of performing maintenance operations using a usage pattern, in which printing work information is generated as the usage pattern at the time when a command to perform a maintenance operation is entered, and maintenance operations are performed when the usage pattern corresponds to the printing work information of printing data, and a method for the same.

In order to achieve the above-described aspects of the present invention, a method for performing a maintenance operation for cleaning a printing unit of an image forming apparatus is provided. The method comprises the steps of recording printing work information as usage pattern information when a command to perform a maintenance operation is entered by a user, counting and recording the printing work information of printing data upon input of a printing command, and comparing the usage pattern information with the counted printing work information. When they correspond to each other, a maintenance operation is performed.

The step of recording printing work information may further comprise the step of recording setup information for performing the maintenance operation.

The method may further comprise the step of, when the usage pattern information does not correspond to the counted printing work information, determining whether the setup information corresponds to the counted printing work information. When the setup information corresponds to the counted printing work information, the maintenance operation of cleaning the printing unit is performed.

The step of comparing the usage pattern information with the counted printing work information may further comprise the steps of displaying a message for determining whether to perform the maintenance operation, and performing the maintenance operation of cleaning the printing unit when the maintenance operation command is input on the message.

The printing work information may be one of the number of paper sheets printed and the quantity of remaining ink.

The method may further comprise the step of changing the usage pattern information when the maintenance operation command is entered to the printing work information which is changed after the maintenance operation is completed.

In accordance with another aspect of the present invention, an image forming apparatus which performs a maintenance operation for cleaning a printing unit using a usage pattern comprises a storage unit that records printing work information as usage pattern information when a command for the maintenance operation is entered, a counter that counts and records the printing work information of printing data upon input of a printing command, a control unit that compares the usage pattern information with the counted printing work information, and a maintenance unit that performs the maintenance operation when the usage pattern information and the counted printing work information correspond to each other.

The storage unit may record setup information for performing the maintenance operation.

The control unit may determine whether the setup information corresponds to the counted printing work information when the usage pattern information does not correspond to the counted printing work information, and perform the maintenance operation of cleaning the printing unit when the setup information corresponds to the counted printing work information.

When the usage pattern information corresponds to the counted printing work information, the control unit may control the display unit to show a message for determining whether to perform the maintenance operation.

The control unit may compare the setup information with the counted printing work information.

The image forming apparatus may further comprise a display unit which shows a message for determining whether to perform the maintenance operation when the usage pattern information corresponds to the counted printing work information.

When the maintenance operation command is input upon the message shown by the display unit, the maintenance unit may perform the maintenance operation.

The printing work information may be one of the number of paper sheets and the quantity of remaining ink.

When the maintenance operation command is input with the printing work information changed, the storage unit may change and record the usage pattern information.

The storage unit may be one of a non-volatile random access memory (NVRAM), a customer replaceable unit memory (CRUM), and a hard disc drive (HDD).

BRIEF DESCRIPTION OF THE DRAWING FIGURES

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

Figure 1:
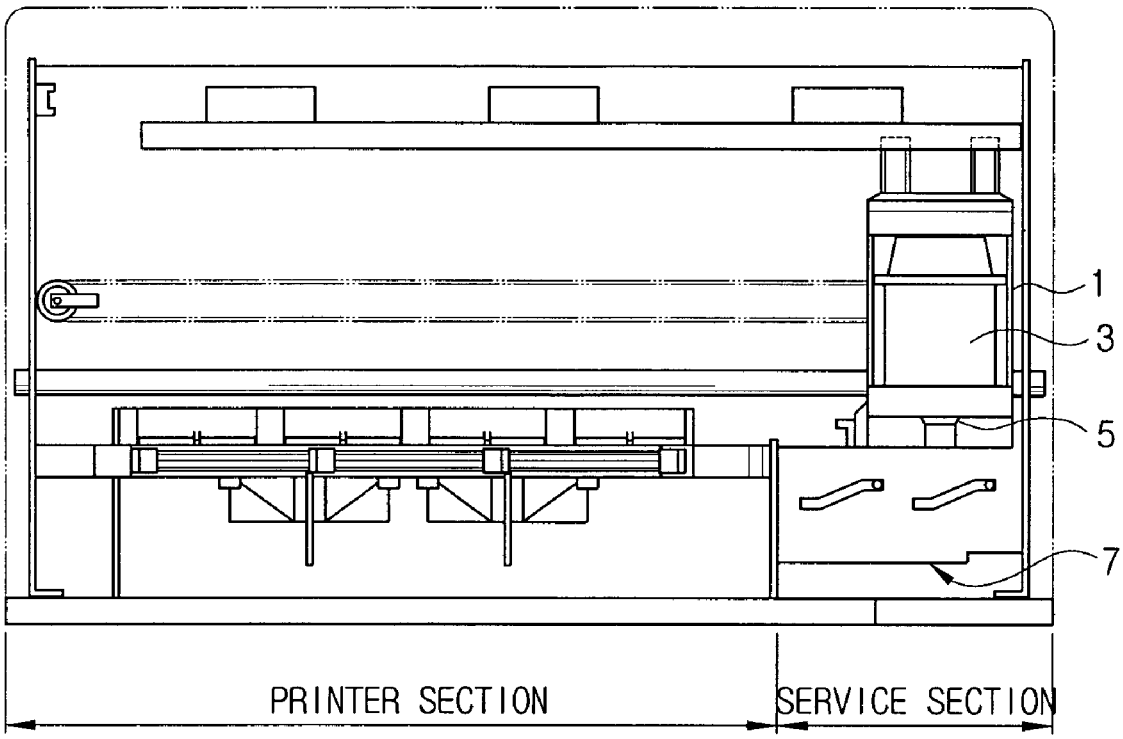
FIG. 1 (PRIOR ART)
FIG. 1 shows a printer body for explaining conventional maintenance operations.
Figure 2:
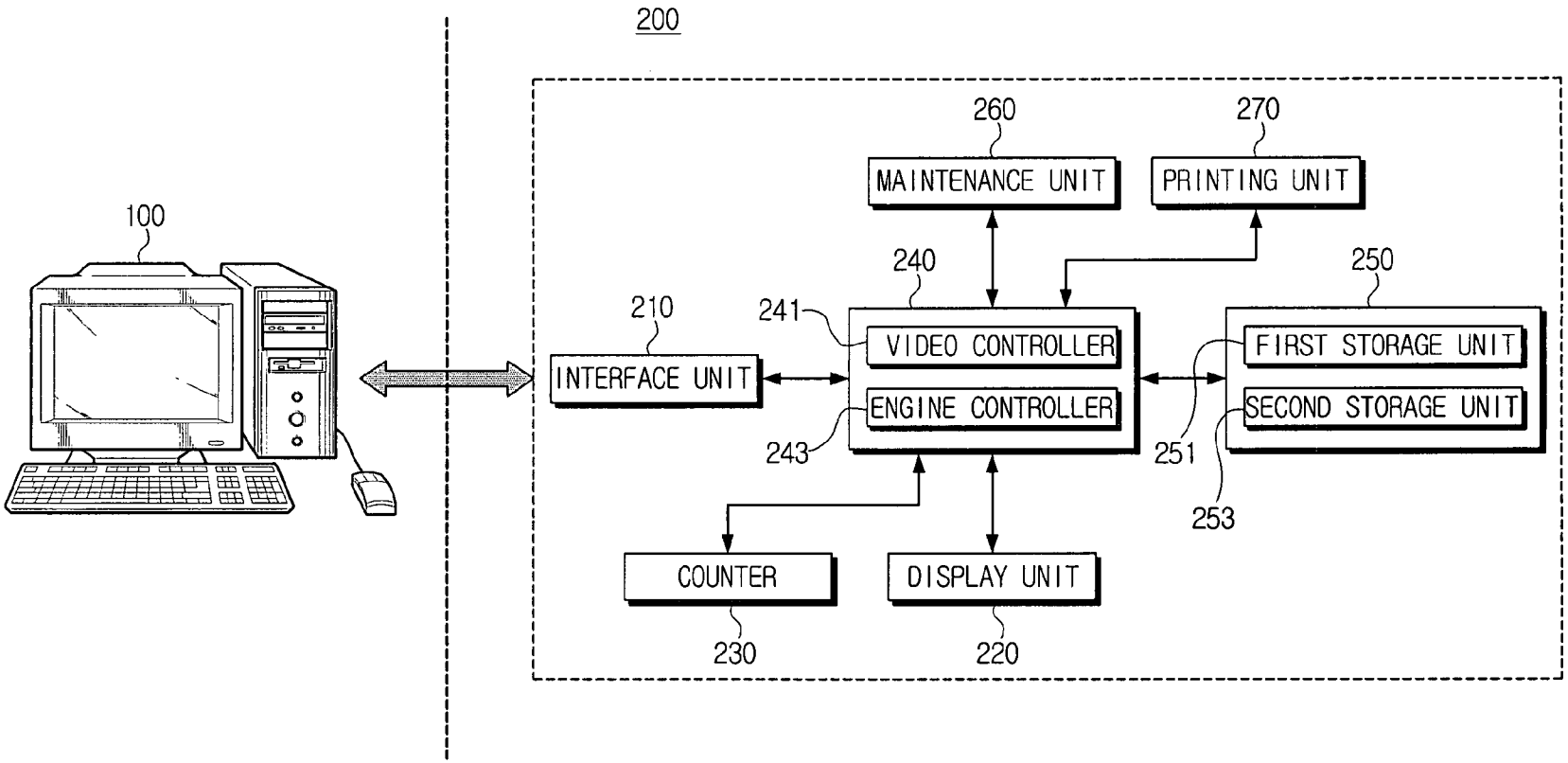
FIG. 2 is a block diagram of an image forming apparatus which performs maintenance operations using a usage pattern, according to an exemplary embodiment of the present invention.

FIG. 2 is a block diagram illustrating an image forming apparatus which performs maintenance operations using a usage pattern, according to an exemplary embodiment of the present invention. A printer 200 is used as an example of an image forming apparatus in this embodiment of the invention, but the present invention is also applicable to other image forming apparatuses.

Referring to FIG. 2, a host device 100 is connected to the printer 200 in parallel, in series, or through a network, and generates printing data to be printed by the printer 200. When a printing command is executed by an application program in the host device, printing data is generated by converting application data to commands that the printer 200 can interpret, and transmitting those commands to the printer 200.

The printer 200 comprises an interface unit 210, a display unit 220, a counter 230, a control unit 240, a storage unit 250, a maintenance unit 260, and a printing unit 270.

The control unit 240 includes a video controller 241 and an engine controller 243. The storage unit 250 includes first and second storage parts 251 and 253.

The interface unit 210 supplies an interface for communication of data with the host device 100. Printing data to be printed by the printing unit 270 and a printing command from the application program of the host device 100 are transmitted through the interface 210.

The display unit 220 shows a variety of information, such as commands input through an operation panel (not shown) by a user and information regarding the printing operations. Preferably, the display unit 220 may be a liquid crystal display (LCD) or a touch-screen display.

When printing data is printed according to a printing command transmitted from the host device 10, the counter 230 counts and records printing related information such as the number of paper sheets printed upon or the quantity of remaining ink.

The storage unit 250 records data related to the printing operations and comprises the first and the second storage parts 251 and 253. The first storage part 251 records, as setup information, printing work information which is standard for the operation of the maintenance unit 260. The second storage part 253 records information relating to a usage pattern, which is printing work information at the moment a command for maintenance operations is input. The storage unit 250 may comprise a non-volatile random access memory (NVRAM), a customer replaceable unit memory (CRUM), a hard disc drive (HDD), or any other suitable form of memory.

The setup information recorded in the first storage part 251 is preset, fixed default information that is set without regard to the input of maintenance operation commands by a user. In contrast, the usage pattern information recorded in the second storage part 253 is modified according to the initiation of a maintenance operation by a user. That is, when a user voluntarily commands a maintenance operation, the printer records printing work information at the time of the command as usage pattern information in the second storage part 253.

Printing work information may include information such as the number of paper sheets printed and the quantity of remaining ink.

The control unit 240 regulates the overall operation of the component parts of the printer 200 and, to this end, comprises the video controller 241 and the engine controller 243. The control unit 240 compares the counted printing work information with the respective information recorded in the first and the second storage parts 251 and 253 to determine whether to perform a maintenance operation. When the printing work information counted by the counter 230 corresponds to the usage pattern information recorded in the second storage part 253, the control unit 240 generates and displays a message for determining whether to perform maintenance operations through the display unit 220.

For example, when the number of paper sheets as preset in the printer 200, the number of paper sheets as recorded in the first storage part 251, and the number of paper sheets used for the printing as counted by the counter 230 all correspond to one another, maintenance operations are automatically performed. If the number of paper sheets as usage pattern information recorded in the second storage part 253 is "100", when the number of paper sheets actually used for printing reaches "100", the display unit 220 shows a message so that the user can input the command for maintenance operations through the printer 200.

The video controller 241 of the control unit 240 converts the printing data transmitted from the printer driver of the host device 100 to a bitmap file. The engine controller 243 transmits the printing data to the printing unit 270 so that the bitmap data can be printed out.

The maintenance unit 260 preferably performs spitting or wiping functions. The spitting function expels droplets of ink through the nozzle and the wiping function cleans ink from the nozzle. When the setup information recorded in the second storage part 253 corresponds to the printing work information counted by the counter 230 and also, and when the user inputs the maintenance operation commands through a message shown on the display unit 220, the maintenance unit 260 performs its functions. Also, the maintenance unit 260 can be operated when the user inputs the maintenance operation command through the printer driver (not shown) of the host device 100. However, if the control unit 240 determines that the setup information recorded in the first storage part 251 corresponds to the printing work information counted by the counter 230, the maintenance unit 260 is operated without having to input the maintenance operation command.

The printing unit 270 prints out the bitmap printing data transmitted from the engine controller 243. When the maintenance unit 260 is operated because the control unit 240 determines that the printing work information counted by the counter 230 and the information recorded in the first or the second storage part 251 or 253 correspond to one another, the operation of the printing unit 270 is suspended.

Figure 3:
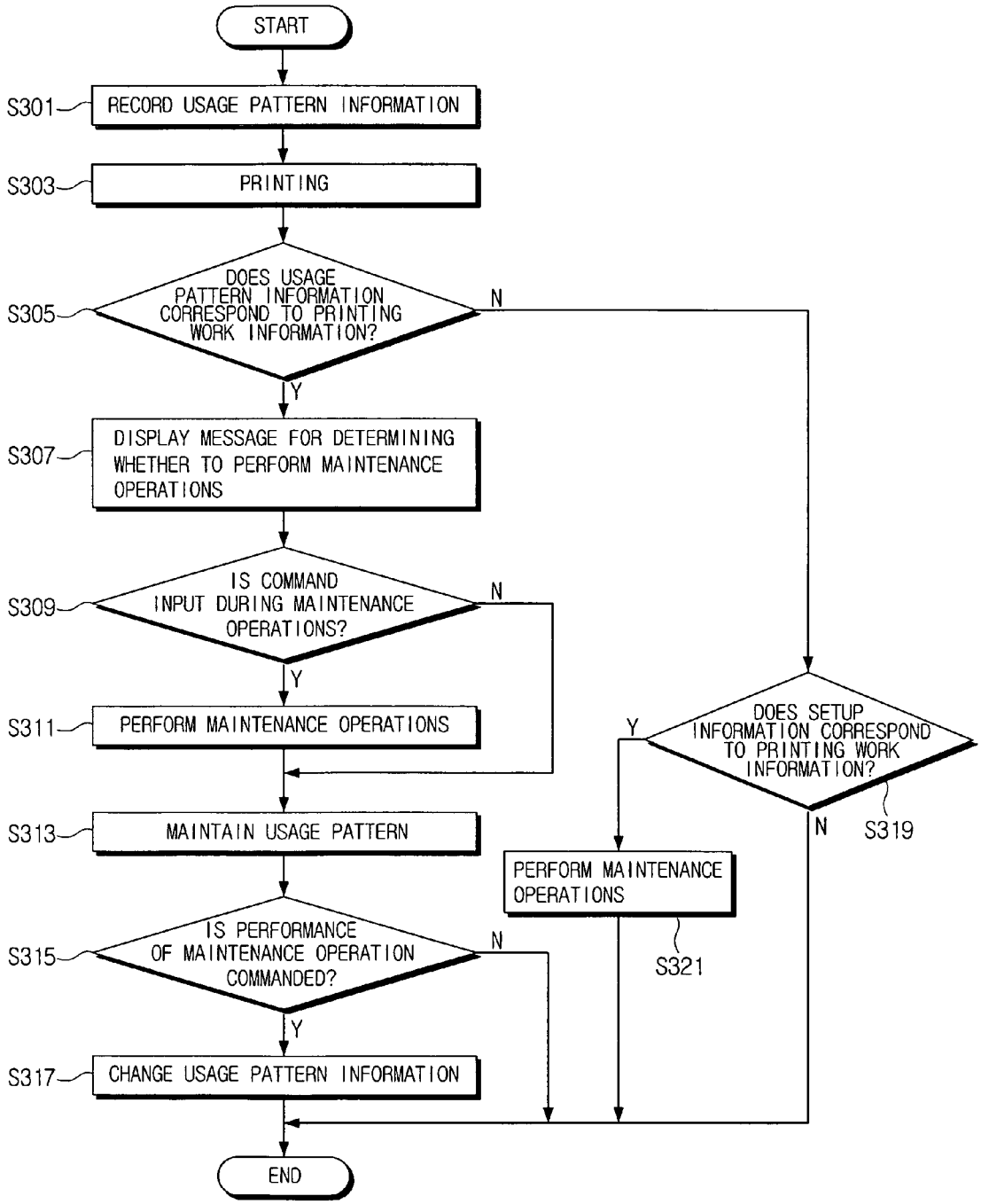
FIG. 3 is a flowchart of a method for performing maintenance operations using a usage pattern, according to an exemplary embodiment of the present invention.

FIG. 3 is a flowchart for explaining a method for performing maintenance operations of an image forming apparatus, using a usage pattern, according to an exemplary embodiment of the present invention.

Referring to FIG. 3, the control unit 240 records the usage pattern information which is the printing work information at the time that a user enters the maintenance operation command through the printer driver of the host device 100 (S301). Here, the printing work information may include the number of paper sheets printed and the quantity of remaining ink. The usage pattern information is recorded in the second storage part 253 and is modifiable. After recording the usage pattern information, when the user changes the printing work information by entering the maintenance operation command again, the usage pattern information is recorded in the second storage unit 253 as updated printing work information. The setup information, which is the standard printing work information for maintenance operations, is preset in the first storage part 251.

For example, if the number of paper sheets used for printing is '100,' and the user enters a maintenance operation command, the control unit 240 updates the usage pattern information by recording '100' in the second storage part 253.

The printing unit 270 prints the printing data transmitted from the host device 100, under control of the engine controller 243 (S303). At this time, the counter 230 counts the number of printed sheets and records the number of paper sheets used during printing.

The control unit 240 determines whether the usage pattern information recorded in the second storage part 253 corresponds to the printing work information counted by the counter 230 (S305).

If the usage pattern information recorded in the second storage 253 and the counted printing work information correspond to each other, the control unit 240 displays a message for deciding whether to perform maintenance operations on display unit 220 (S307). On the other hand, if the usage pattern information does not correspond to the counted printing work information, the setup information is compared to the printing work information, as will be discussed below with respect to step S319.

The control unit 240 determines the user's choice of whether to perform or cancel the maintenance operation command shown in the message displayed by the display unit 220 (S309).

When the user chooses to perform the maintenance operation, a maintenance operation for cleaning the printing unit 270 is performed (S311). In particular, when the user enters the maintenance operation command through the message shown by the display unit 220, the maintenance operation command is transmitted to the control unit 240, so that the control unit 240 controls the maintenance unit 260 to perform maintenance operations. If the maintenance operation command is input through the message during printing, the printing work is suspended while the maintenance operation is performed.

When the maintenance operation command is input, the usage pattern information recorded in the second storage part 253 is maintained (S313). Similarly, when the user does not select performance of maintenance operations upon the message shown through the display unit 220 in step S309, the maintenance unit 260 does not perform maintenance operations and therefore, the usage pattern information recorded in the second storage part 253 is maintained.

Next, the control unit 240 determines whether a new maintenance operation command is input (S315). More specifically, the control unit 240 determines whether a maintenance operation command, which does not correspond to the usage pattern information recorded in the second storage part 253, is input through the printer driver of the host device 100. When a new maintenance operation command is input through the printer driver, the usage pattern information recorded in the second storage part 253 is changed (S317).

When the usage pattern information does not correspond to the printing work information in step S305, the control unit 240 determines whether the setup information recorded in the first storage part 251, which is the standard printing work information for maintenance operations, corresponds to the printing work information counted by the counter 230 at step S319. If the setup information recorded in the first storage part 251 and the counted printing work information correspond to each other, maintenance operations are automatically performed (S321). If they do not correspond to each other, the operation of the printer 200 is finished after printing the printing data.

Figure 4:
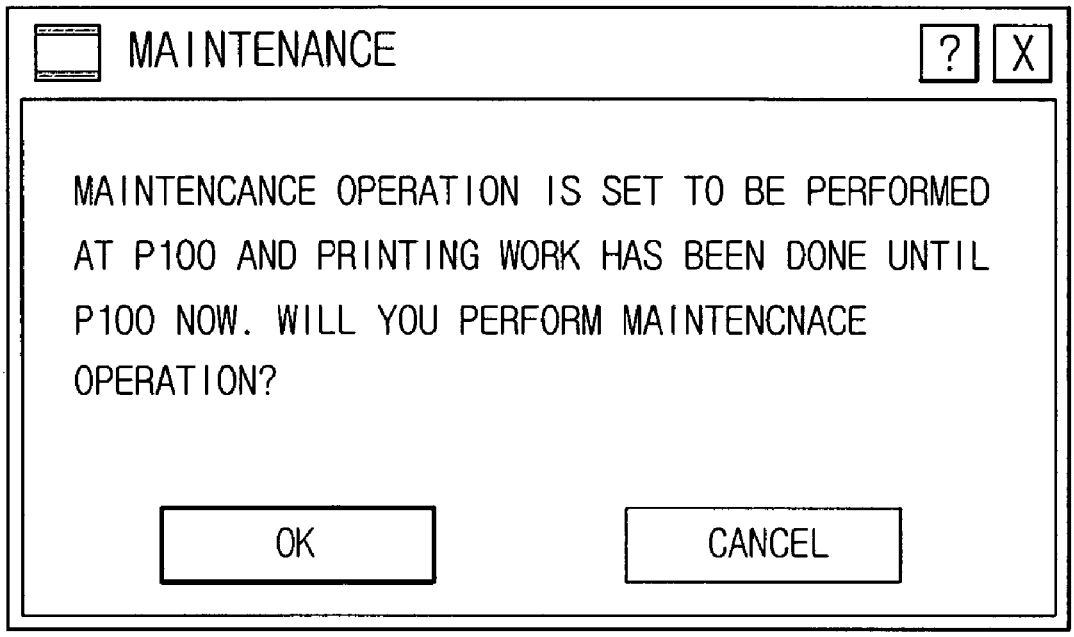
FIG. 4 shows a message displayed on a display unit of the image forming apparatus to determine whether to perform maintenance operations, according to an exemplary embodiment of the present invention.

FIG. 4 illustrates a message shown through the display unit 220, for determining whether to perform maintenance operations, according to an exemplary embodiment of the present invention. In this exemplary embodiment, as an example of the usage pattern information, the number of paper sheets is '100'.

Referring to FIG. 4, when the number of paper sheets as recorded in the second storage part 253 is the same as that as counted by the counter 230, the message for determining whether to perform maintenance operations is shown through the display unit 220. When the number of paper sheets actually used for the printing becomes '100' after the user's input of a command for the printing, since this corresponds to the usage pattern information, the message for determining whether to perform the maintenance operation command is displayed to notify the user that the user has requested performance of maintenance operations when the number of paper sheets is '100'.

The displayed message includes an execution button ("OK") for executing the maintenance operation command and a cancellation button ("CANCEL") for canceling the message window. Therefore, the user can command performance of maintenance operations by selecting the execution button.

As described above with respect to the exemplary embodiment of the present invention, maintenance operations can be performed according to patterns of the maintenance operation set by the user, thereby enabling convenient printing work.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A method for performing a maintenance operation for cleaning a printing unit of an image forming apparatus, the method comprising the steps of:

(a) recording printing work information as usage pattern information when a command for the maintenance operation is entered and recording setup information for performing the maintenance operation;

(b) counting and recording the printing work information of printing data upon input of a printing command; and (c) comparing the usage pattern information with the counted printing work information and, when the counted printing work information is equal to the usage pattern information, performing the maintenance operation;

(d) when the usage pattern information does not equal the counted printing work information, determining whether the setup information is equal to the counted printing work information; and (e) when the setup information is equal to the counted printing work information, performing the maintenance operation of cleaning the printing unit.

2. The method of claim 1, wherein step (c) further comprises the steps of:

displaying a message for determining whether to perform the maintenance operation; and performing the maintenance operation of cleaning the printing unit when a maintenance operation command is entered upon the display of the message.

3. The method of claim 1, wherein the printing work information is one of the number of paper sheets and the quantity of remaining ink.

4. The method of claim 1, further comprising the step of when the maintenance operation command is input, changing the usage pattern information to the printing work information after the maintenance operation is completed.

5. An image forming apparatus which performs a maintenance operation for cleaning a printing unit using a usage pattern, the image forming apparatus comprising:

a storage unit that records printing work information as usage pattern information when a command to perform a maintenance operation is entered;

a counter that counts and records printing work information of printing data upon input of a printing command;

a control unit that compares the usage pattern information with the counted printing work information; and a maintenance unit that performs the maintenance operation when the usage pattern information and the counted printing work information correspond to each other;

wherein the storage unit records setup information for performing the maintenance operation; and the control unit determines whether the setup information is equal to the counted printing work information when the usage pattern information does not equal the counted printing work information, and performs the maintenance operation of cleaning the printing unit when the setup information is equal to the counted printing work information.

6. The image forming apparatus of claim 5, wherein the control unit compares the setup information with the counted printing work information.

7. The image forming apparatus of claim 5, further comprising a display unit which shows a message for determining whether to perform the maintenance operation when the usage pattern information is equal to the counted printing work information.

8. The image forming apparatus of claim 7, wherein when the maintenance operation command is input upon the message shown by the display unit, the maintenance unit performs the maintenance operation.

9. The image forming apparatus of claim 5, wherein the printing work information is one of the number of paper sheets and quantity of remaining ink.

10. The image forming apparatus of claim 5, wherein when the maintenance operation command is input with the printing work information changed, the storage unit changes and records the usage pattern information.

11. The image forming apparatus of claim 5, wherein the storage unit is one of a non-volatile random access memory (NVRAM), a customer replaceable unit memory (CRUM) and a hard disc drive (HDD).

12. The image forming apparatus of claim 5, wherein when the usage pattern information is equal to the counted printing work information, the control unit controls the display unit to show a message for determining whether to perform the maintenance operation.

* * * * *